US010750884B2

(12) United States Patent
Hansen

(10) Patent No.: US 10,750,884 B2
(45) Date of Patent: Aug. 25, 2020

(54) SKATEBOARD STAND

(71) Applicant: Roger Hansen, Tulsa, OK (US)

(72) Inventor: Roger Hansen, Tulsa, OK (US)

( * ) Notice: Subject to any disclaimer, the term of this patent is extended or adjusted under 35 U.S.C. 154(b) by 0 days.

(21) Appl. No.: 16/364,318

(22) Filed: Mar. 26, 2019

(65) Prior Publication Data

US 2019/0298087 A1 Oct. 3, 2019

Related U.S. Application Data

(60) Provisional application No. 62/648,641, filed on Mar. 26, 2019.

(51) Int. Cl.
*A47F 7/00* (2006.01)
*A63C 17/00* (2006.01)
*A47F 5/10* (2006.01)

(52) U.S. Cl.
CPC ..... *A47F 7/0042* (2013.01); *A47F 5/108* (2013.01); *A63C 17/0006* (2013.01)

(58) Field of Classification Search
CPC .... A47F 7/0042; A47F 7/0021; A47F 7/0035; A47F 5/108; A47F 5/11; A47F 5/112; A63C 17/0006; B25H 1/00
USPC ..... 211/85.7, 90.01
See application file for complete search history.

(56) References Cited

U.S. PATENT DOCUMENTS 773,177 A * 10/1904 Wilson ..... A47B 23/042 248/459
809,785 A * 1/1906 Dahlberg ..... A47B 23/042 248/459
1,086,690 A * 2/1914 Rosenberg ..... A47F 5/112 248/174
1,134,802 A * 4/1915 Agar ..... A47B 23/042 248/459
1,272,349 A * 7/1918 Abrahams ..... A47F 5/112 248/450
1,301,797 A * 4/1919 Ziegler ..... A47F 7/04 211/24
1,342,313 A * 6/1920 Stranders ..... A47F 5/112 248/174
1,391,479 A * 9/1921 Kazanjian ..... A47B 65/00 248/174
1,415,224 A * 5/1922 Dickmeyer ..... A47F 5/112 248/459
1,579,099 A * 3/1926 Fernstrom ..... A47F 5/112 248/174
3,282,437 A * 11/1966 Hansen ..... A47F 7/0064 211/41.7

(Continued)

FOREIGN PATENT DOCUMENTS

JP 2001109385 4/2001

OTHER PUBLICATIONS

Korean Intellectual Property Office; International Search Report and Written Opinion of the International Searching Authority; dated Jul. 5, 2019.

*Primary Examiner* — Patrick D Hawn
(74) *Attorney, Agent, or Firm* — Head, Johnson, Kachigian & Wilkinson, PC

(57) ABSTRACT

A stand for a skateboard or other board that is capable of folding flat for shipping, storage, and store display of the stand, but that can be folded into a three-dimensional shape capable of holding a skateboard upright, either vertically or horizontally, for storage and/or for display of the skateboard.

11 Claims, 7 Drawing Sheets

(56) References Cited

U.S. PATENT DOCUMENTS

| | | | | | |
|---|---|---|---|---|---|
| 3,999,734 | A * | 12/1976 | Gibson | A47F 7/142 | 248/460 |
| 5,141,115 | A | 8/1992 | Nicoll | | |
| 5,277,388 | A * | 1/1994 | Denaro | A47F 5/112 | 206/45.25 |
| 5,301,800 | A * | 4/1994 | Kenney | A47F 7/147 | 206/449 |
| 5,388,798 | A * | 2/1995 | Glick | A47G 1/142 | 248/453 |
| 5,660,365 | A * | 8/1997 | Glick | A47B 23/042 | 248/174 |
| 6,269,961 | B1 * | 8/2001 | Porcelli | A47F 5/112 | 211/70.7 |
| 6,382,581 | B1 * | 5/2002 | Duff | A47B 97/08 | 248/165 |
| 6,604,639 | B2 | 8/2003 | Chen | | |
| 7,434,771 | B1 * | 10/2008 | Tai | F16L 3/00 | 138/106 |
| D595,966 | S * | 7/2009 | Larsen | D6/310 | |
| 8,833,570 | B2 | 9/2014 | Hoppus | | |
| D787,202 | S * | 5/2017 | Martin | D6/310 | |
| 9,962,596 | B2 * | 5/2018 | Corrales | A63C 17/0013 | |
| 2004/0118797 | A1 | 6/2004 | Cormier | | |
| 2010/0122958 | A1 * | 5/2010 | Tsai | B62H 3/04 | 211/22 |
| 2016/0023087 | A1 * | 1/2016 | Corrales | A63C 17/0013 | 248/677 |
| 2018/0049549 | A1 * | 2/2018 | Conrad | A47B 97/08 | |

* cited by examiner

SKATEBOARD STAND

CROSS REFERENCE

This application is based on and claims priority to U.S. Provisional Patent Application No. 62/648,641 filed Mar. 27, 2018.

BACKGROUND OF THE INVENTION

Field of the Invention

This invention relates generally to a skateboard stand, and more particularly, but not by way of limitation, to a skateboard stand capable of folding flat for storage and shipping.

Description of the Related Art

A skateboard is a three-dimensional, non-planar object with a center of gravity that does not align with any of the perimeter surfaces of the boards. This results in an instability when trying to store the board in an upright position. Skateboard users often prop their skateboards against walls or furniture when not in use. The inherent instability of skateboards, however, makes the skateboard prone to sliding down, leaving a mark or mar on the wall or furniture against which it was propped.

Leaving the skateboard on the floor is not a better option, as it takes up space and produces a tripping hazard. This is particularly true given the inherent rolling nature of a skateboard.

Skateboard racks are sometimes used, but these typically require wall space or dedicated floor space and cannot be easily moved. Wall-mounted racks in particular are an issue, as they require placing holes in walls, which can be unsightly when the rack is removed and may be prohibited in apartments or other rental property.

Small skateboard stands may overcome many of these issues, allowing a skateboard to be stored upright without touching a wall or furniture. Small stands may be easily moved as desired. Such stands, however, are typically bulky and often heavy. Thus, they cannot be easily stored when not in use and they can be costly to ship.

Based on the foregoing, it is desirable to provide a skateboard stand that is capable of holding a skateboard in an upright position, either vertically or horizontally, but also capable of being folded flat for storage and/or shipping.

It is further desirable for the stand to be lightweight yet stable.

It is further desirable for the stand to be a unitary structure for ease of manufacture and assembly.

SUMMARY OF THE INVENTION

In general, in a first aspect, the invention relates to a stand capable of supporting a skateboard, where the stand is capable of being stored or shipped flat. All parts of the stand may be formed unitarily and may be made of a single, undivided piece of material. Alternately, one or more parts of the stand may be separate and unconnected from one or more of the remaining parts when the stand is disassembled.

The stand may comprise a horizontal support, a right side, a left side, and a lateral support, where the horizontal support, the right side, the left side, and the lateral support are capable of lying in the same plane when the stand is not in use. The stand may further comprise a slot in the right side and a slot in the left side, where the slots are capable of receiving the skateboard. The lateral support may be a front face attached to the front edge of the horizontal support, a mid support attached to the back edge of the horizontal support, or both.

The right side may be attached to a right edge of the horizontal support, the left side may be attached to a left edge of the horizontal support, and the lateral support may be attached to a front edge or a back edge of the horizontal support. The right side may be capable of folding upright or downward relative to the horizontal support, the left side may be capable of folding upright or downward relative to the horizontal support, and the lateral support may be capable of folding upright or downward relative to the horizontal support and being removably attached to the right side and the left side.

The right side may be attached to the right edge of the horizontal support via a hinge, the left side may be attached to the left edge of the horizontal support via a hinge, and the lateral support may be attached to the front edge or the back edge of the horizontal support via a hinge. The three hinges may be living hinges.

The stand may further comprise: at least one tab projecting from a front or back edge of the right side; at least one tab projecting from a front or back edge of the left side; at least one slot in the lateral support corresponding to the tab projecting from the front or back edge of the right side; and at least one slot in the lateral support corresponding to the tab projecting from the front or back edge of the left side, where the slots are capable of receiving and removably retaining their corresponding tabs.

Figure 1:
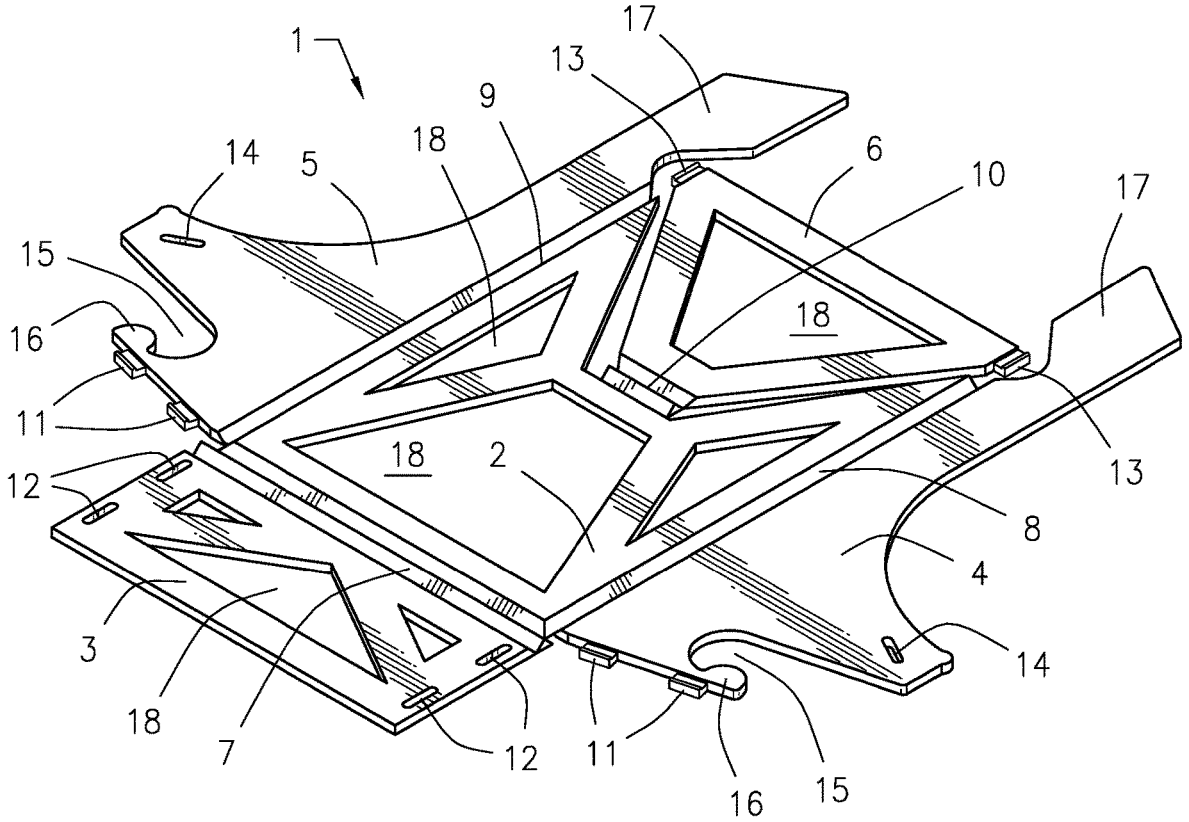
FIG. 1 is a perspective view of the skateboard stand in a flat configuration.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a skateboard stand 1 that can be folded flat for shipping, storage, and store display of the stand, but that can be folded into a three-dimensional shape capable of holding a skateboard upright, either vertically or horizontally, for storage and/or for display of the skateboard. The stand 1 is designed for use with a skateboard, but can be used as a stand for other objects, as well. For example, the stand 1 may be used with other types of board products, such as snowboards, wakeboards, and/or surfboards.

As shown in the drawings, the stand 1 may have a horizontal support 2, at least one lateral support, a right side 4, and a left side 5. The lateral support may be a front face 3 or a mid support 6. For more stability, the stand 1 may have both a front face 3 and a mid support 6.

The horizontal support 2 may be located at the bottom of the stand 1 when assembled, as shown in FIGS. 1 through 12. Alternately, the horizontal support 2 may be located at the top of the stand 1 when assembled, as shown in FIGS. 13 through 16. In either embodiment, the front face 3 may attach to the front edge of the horizontal support 2 via a hinge 7. The right side 4 may attach to the right edge of the horizontal support 2 via a hinge 8, while the left side 5 may attach to the left edge of the horizontal support 2 via a hinge 9. If the mid support 6 is included, the mid support 6 may attach to the back edge of the horizontal support 2 via a hinge 10. Optionally, the stand 1 may include the mid support 6 but omit the front face 3.

Figure 15:
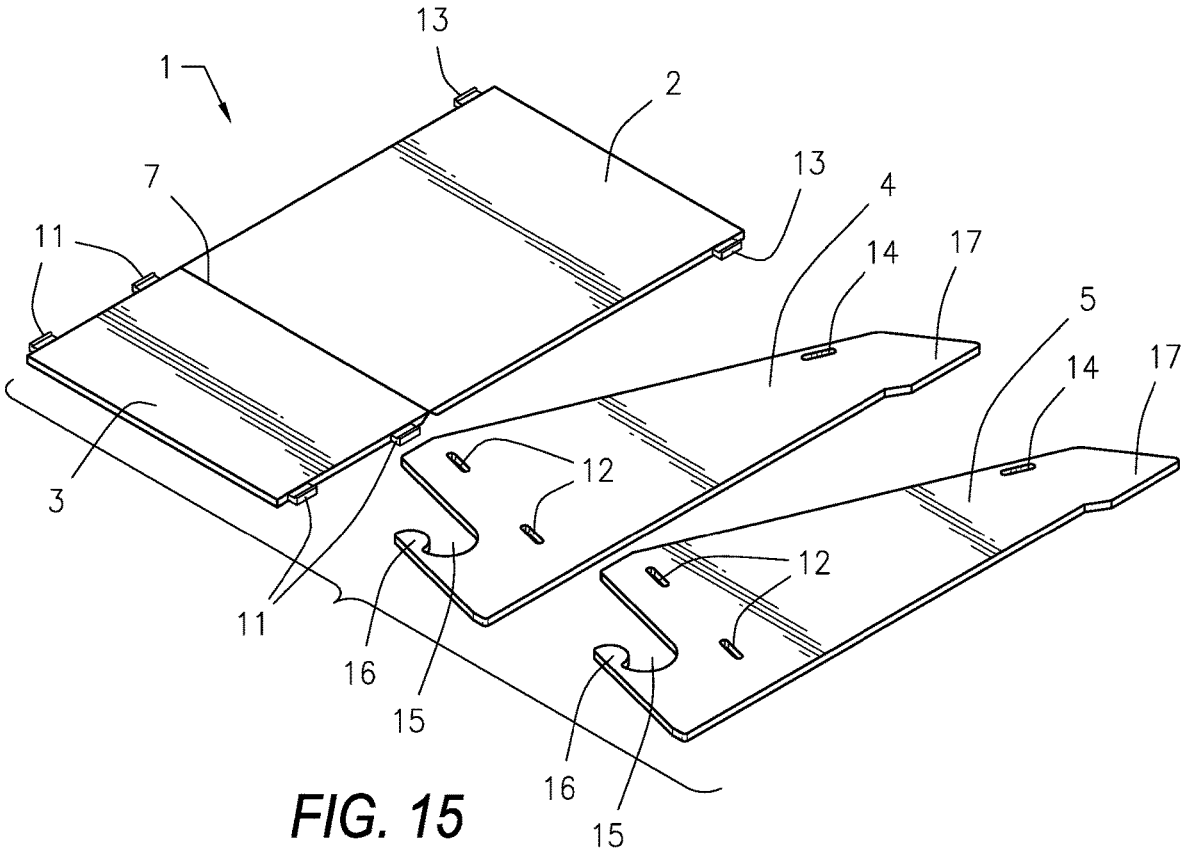
FIG. 15 is a perspective view of a three-part version of the skateboard stand in a flat configuration.
Figure 16:
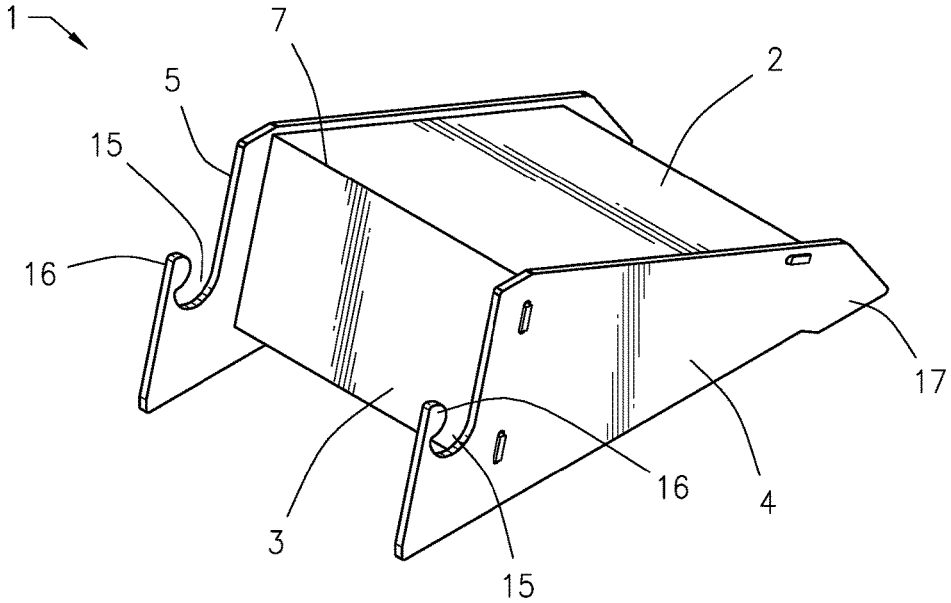
FIG. 16 is a perspective view of the three-part version of the skateboard stand in an assembled configuration.

The horizontal support 2, front face 3, right side 4, and left side 5, as well as the mid support 6 if present, may all be formed of the same material, as one piece, with a unitary design. If so, hinges 7, 8, 9, and 10 may all be living hinges. Alternately, one or more of the front face 3, right side 4, left side 5, and/or mid support 6 may be a separate piece, and the corresponding hinge or hinges 7, 8, 9, and/or 10 may be any desired type of hinge. Alternately, if any of the front face 3, right side 4, left side 5, or mid support 6 is a separate piece, the hinge corresponding to that piece may be omitted, with the piece connecting directly to the horizontal support 2, such as by snapping into place, or any other desired connection. For example, as shown in FIGS. 15 and 16, the horizontal support 2 and the front face 3 may be one piece with a living hinge 7, while the right side 4 and the left side 5 may be separate pieces that snap into place.

During use, the stand 1 may be folded and/or assembled into a structure capable of holding a skateboard in an upright position, either vertically or horizontally. In particular, when the horizontal support 2 is located at the bottom of the stand 1 when assembled and the stand 1 has a unitary design, the right side 4 and the left side 5 may each be folded upward relative to the horizontal support 2. The right side 4 and the left side 5 may each lie perpendicular to the horizontal support 2, or may lie at any other desired angle. The front face 3 may likewise be folded upward relative to the horizontal support 2. Alternately, when the horizontal support 2 is located at the top of the stand 1 when assembled and the stand 1 has a unitary design, the right side 4 and the left side 5 may each be folded downward relative to the horizontal support 2. The right side 4 and the left side 5 may each lie perpendicular to the horizontal support 2, or may lie at any other desired angle. The front face 3 may likewise be folded downward relative to the horizontal support 2.

Figure 2:
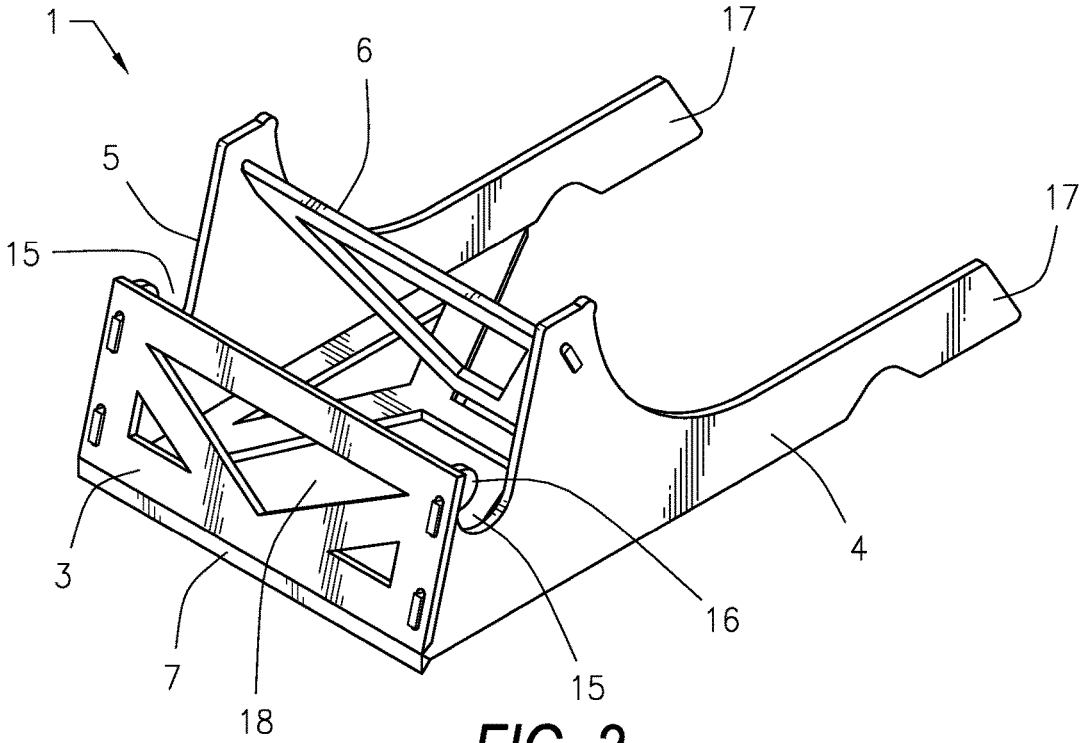
FIG. 2 is a perspective view of the skateboard stand in an assembled configuration.
Figures 3, 4, 5:
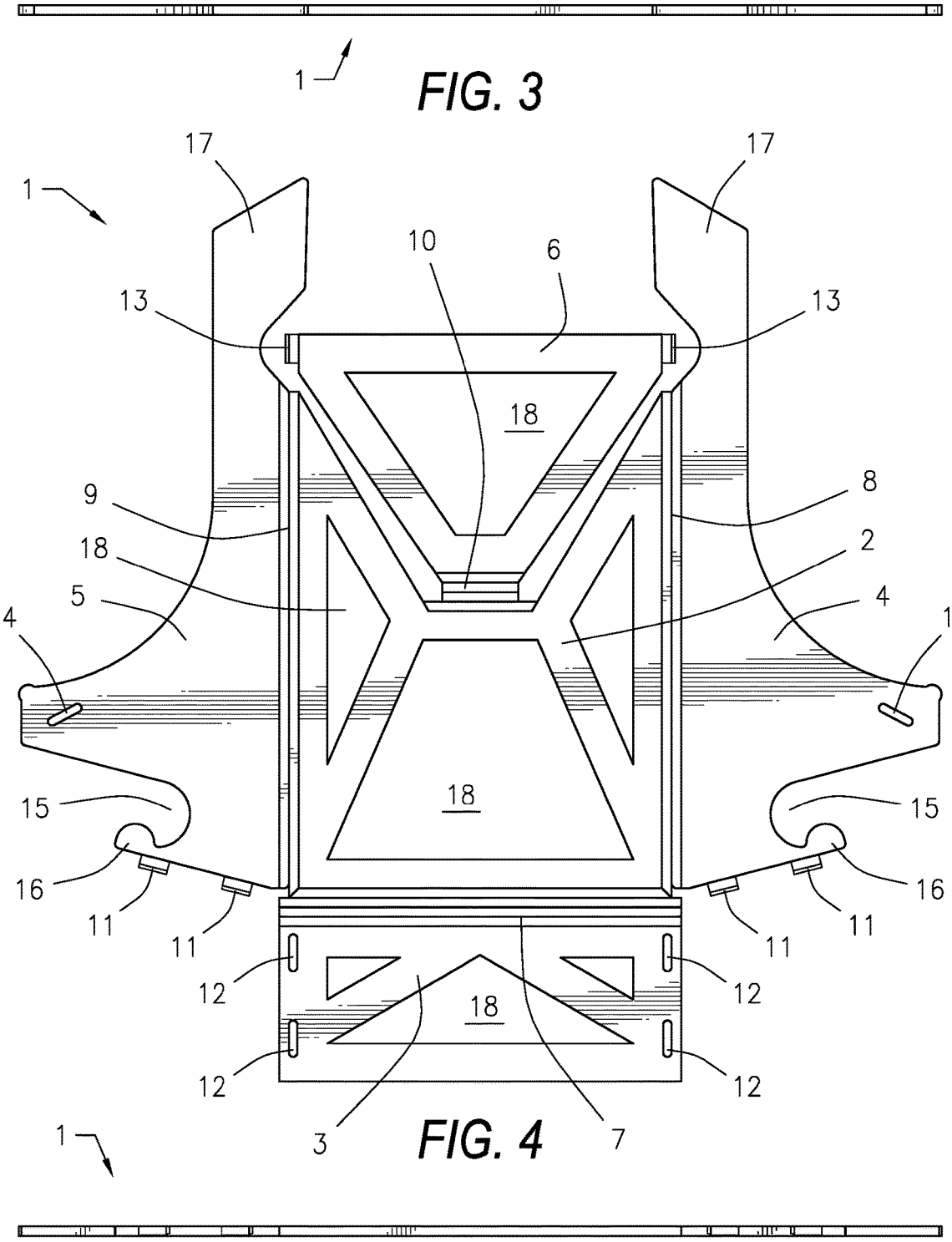
FIG. 3 is a back view of the skateboard stand in the flat configuration.
FIG. 4 is a bottom view of the skateboard stand in the flat configuration.
FIG. 5 is a front view of the skateboard stand in the flat configuration.
Figure 6:
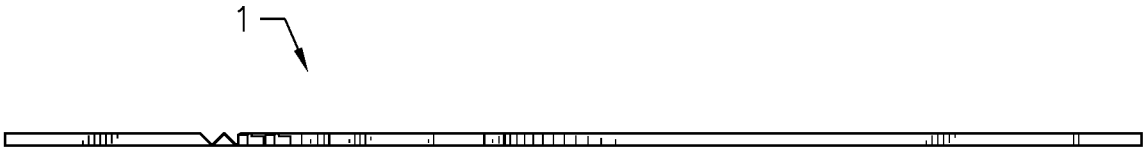
FIG. 6 is a side view of the skateboard stand in the flat configuration.
Figure 7:
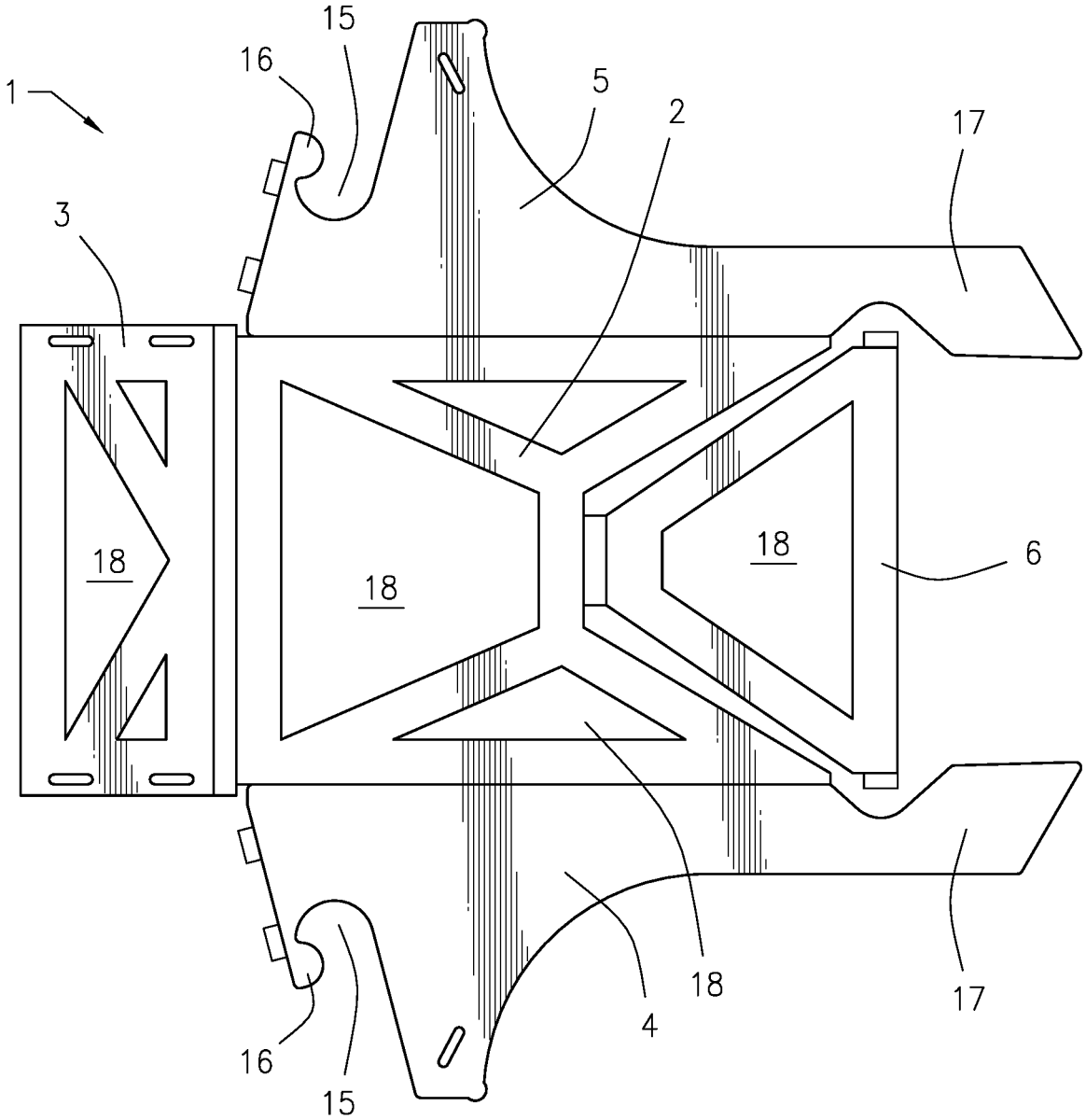
FIG. 7 is a top view of the skateboard stand in the flat configuration.
Figure 8:
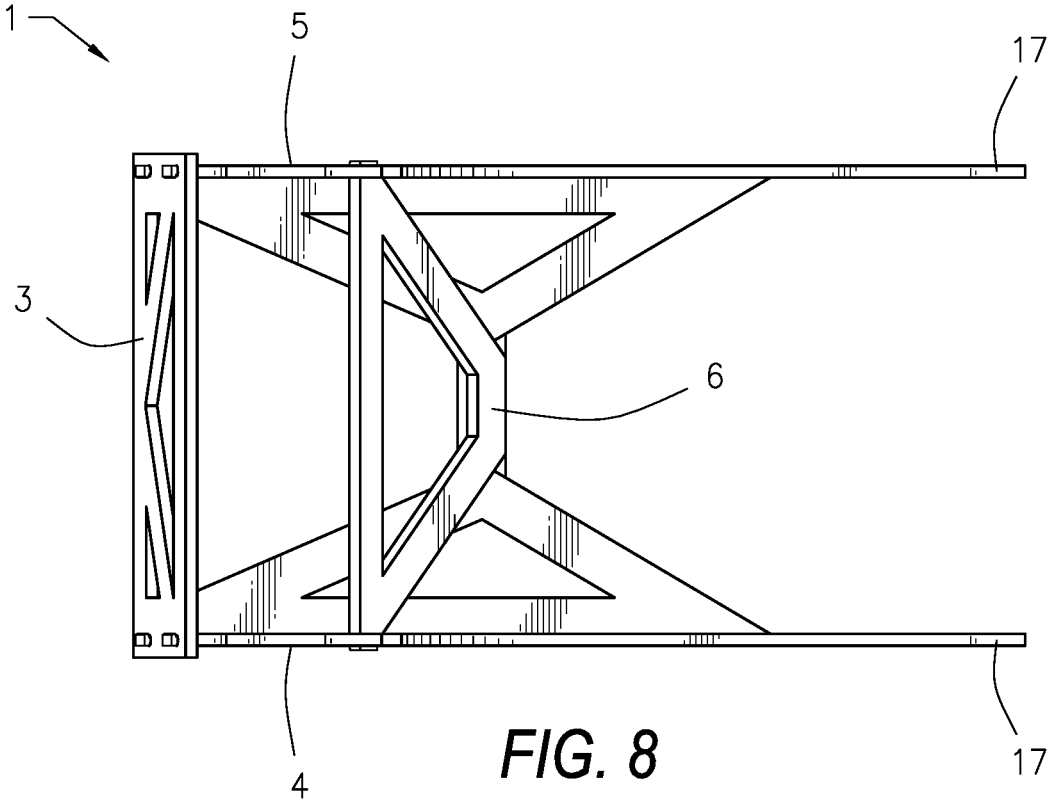
FIG. 8 is a top view of the skateboard stand in the assembled configuration.
Figure 9:
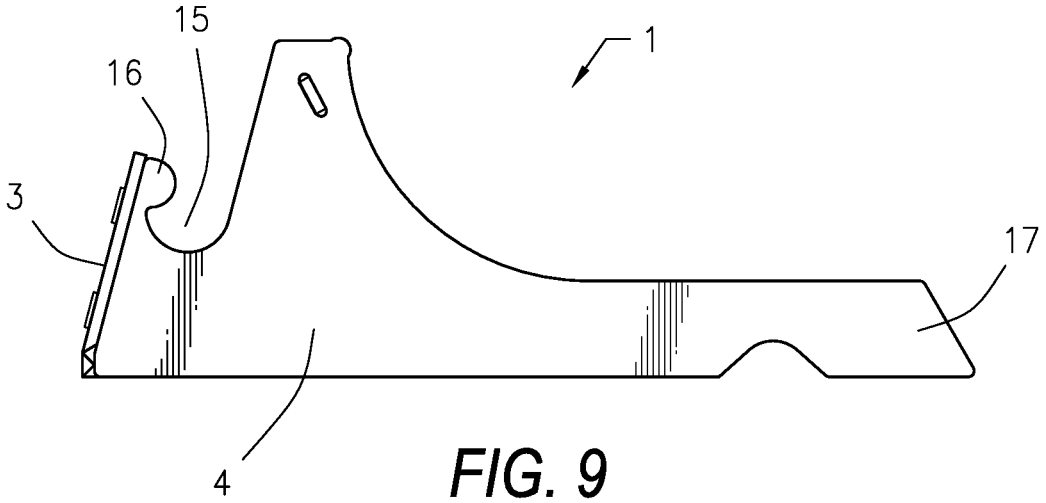
FIG. 9 is a side view of the skateboard stand in the assembled configuration.
Figure 10:
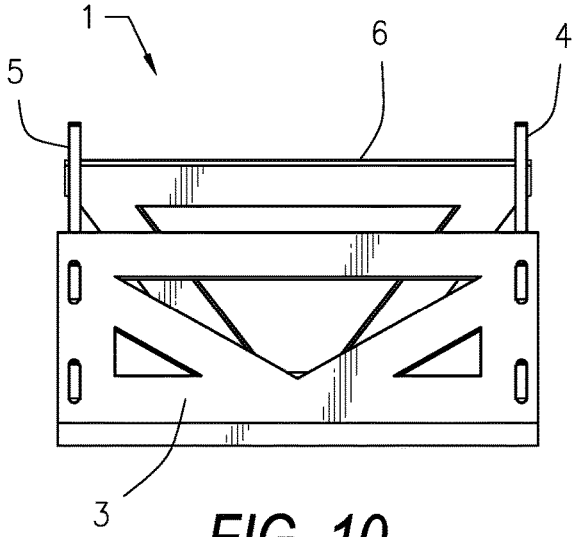
FIG. 10 is a front view of the skateboard stand in the assembled configuration.
Figure 11:
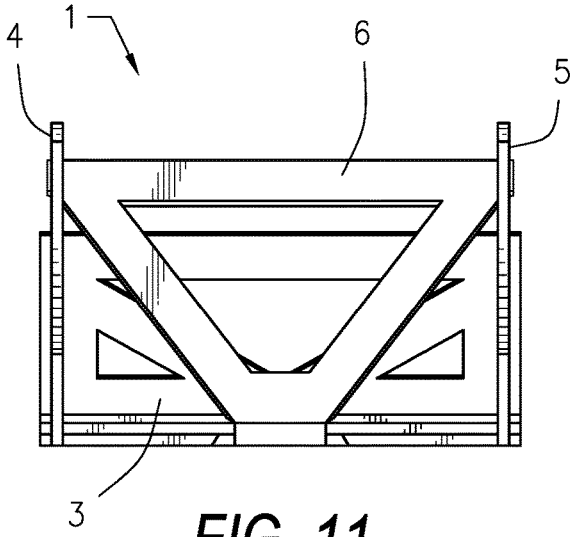
FIG. 11 is a back view of the skateboard stand in the assembled configuration.
Figure 12:
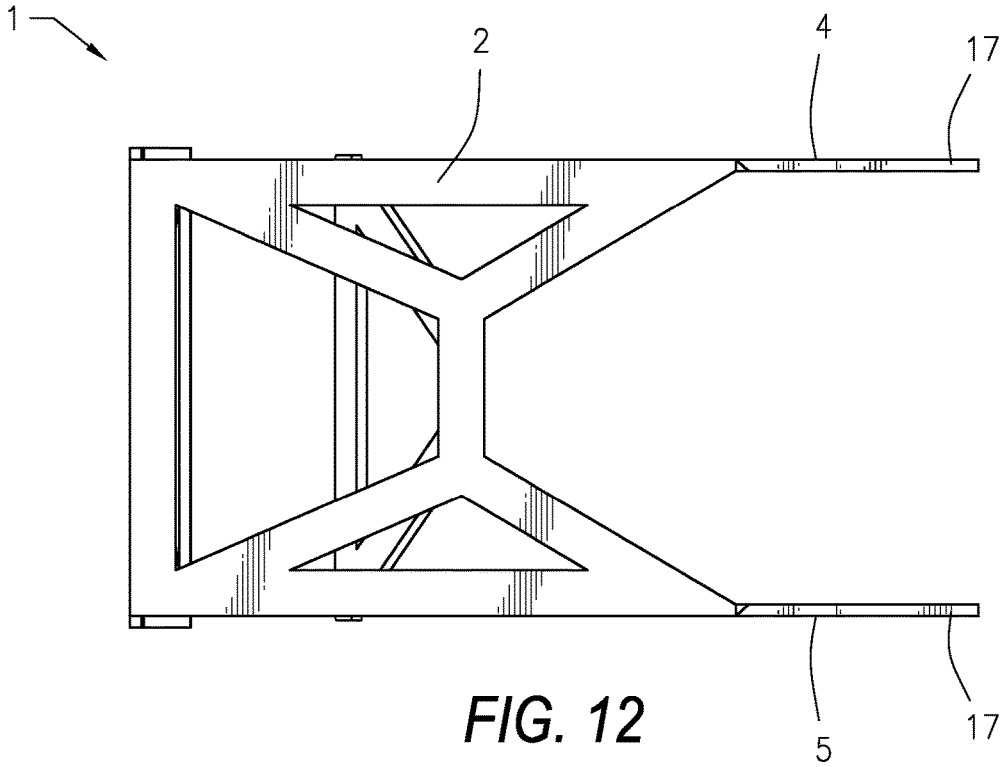
FIG. 12 is a bottom view of the skateboard stand in the assembled configuration.

Whether the horizontal support 2 is at the top or the bottom of the stand 1 when assembled, the sides of the front face 3 may removably attach to the front edges of the sides 4 and 5, as shown in FIG. 2. For example, the sides 4 and 5 may each have one or more tabs 11 projecting forward from the front edges thereof, and the front face 3 may have corresponding slots 12 located on either side thereof, such that the tabs 11 may be receivable in the slots 12. Alternately, tabs 11 may be located on the front face 3 and slots 12 on sides 4 and 5, or some tabs 11 may be located on the front face 3 and some on the sides 4 and 5 and some slots 12 may be located on the sides 4 and 5 and some on the front face 3. The tabs 11 may be formed such that they snap into and are retained within the slots 12, allowing the front face 3 to removably attach to the right side 4 and the left side 5. Alternately, the front face 3 may attach to the sides 4 and 5 any other desired way, removably or otherwise, such as via any mechanical connection and/or via separate fasteners.

The front edges of the right side 4 and the left side 5 may each taper slightly backward from bottom to top, allowing the front face 3 to angle slightly inward from bottom to top when removably attached to the right side 4 and the left side 5, as shown. Alternately, the front edges of the sides 4 and 5 may not taper, allowing the front face 3 to lie perpendicular to the horizontal support 2, or may taper slightly forward from bottom to top, allowing the front face 3 to angle slightly outward from bottom to top, as desired.

If the mid support 6 is included, the mid support 6 may be folded upward or downward relative to the horizontal support 2, depending on whether the horizontal support is located at the top or bottom of the stand 1 when assembled, and may removably attach to the right side 4 and the left side 5. For example, each of the sides of the mid support 6 may have one or more outwardly projecting tabs 13, while the right side 4 and the left side 5 may each have one or more corresponding slots 14, such that the tabs 13 may be receivable in the slots 14. Alternately, one, some, or all of the tabs 13 may be located on the right side 4 or left side 5 and one, some, or all of the slots 14 may be located on the mid support 6. The tabs 13 may be formed such that they snap into and are retained within the slots 14, allowing the mid support 6 to removably attach to the right side 4 and the left side 5. Alternately, the mid support 6 may attach to the sides 4 and 5 any other desired way, removably or otherwise, such as via any mechanical connection and/or via separate fasteners.

The slots 14 may be located forward of the hinge 10, such that the mid support 6 may angle forward from bottom to top. Alternately, the slots 14 may be located such that the mid support 6 is perpendicular to the horizontal support 2 or angles backward from bottom to top, as desired.

If the right side 4 and the left side 5 each lie perpendicular to the horizontal support 2, the hinges 8 and 9 may be designed to prohibit folding the right side 4 and the left side 5 further than 90 degrees. For example, the hinges 8 and 9 may be living hinges with a chamfer or taper on each side of the hinge 8 or 9 angling at 45 degrees, forming a 90-degree living hinge. The opposite side of hinges 8 and 9 may be designed to fold back 180-degrees. Thus, the right side 4 and left side 5 may be folded fully backward toward the bottom of horizontal support 2, but only up to 90 degrees upward. The hinge 7, on the other hand, may be designed to allow the front face 3 to be folded fully either front or back. For example, the hinge 7 may be a three-part living hinge, allowing a full range of motion backward to lie flat against the bottom of the horizontal support 2 or forward to lie flat against the top of the horizontal support 2. Alternately, the hinge 7 may be designed to offer any other desired range of motion. If the mid support 6 is included, hinge 10 may likewise be designed to allow the mid support 6 to be folded fully either front or back, such as a three-part living hinge with full range of motion, or any other desired range of motion.

The stand 1 may feature one or more slots 15 into which the skateboard may be placed. For example, as shown, slots 15 may be located in both the right and left sides 4 and 5. The slots 15 may optionally include a lip 16, as shown. The lip 16 is not required, but may be included to provide a deterministic point of contact. The slots 15 may be positioned such that they are capable of supporting the skateboard in an upright position, either horizontally or vertically. Thus, the width of the horizontal support 2, and thus the distance between the right side 4 and the left side 5, may be as great as possible while still narrow enough to support a skateboard in both slots 15 when the skateboard is placed in a vertical orientation.

The stand 1 may include one or more foot 17 extending backward. The stand 1 may additionally feature one or more foot 17 extending forward, if desired, for additional stability. Each side 4 and 5 may include a foot 17, as shown. Thus, each side 4 and 5 may be elongate, allowing the feet 17 to extend sufficiently back from the slot 15 to counterbalance the skateboard when in place on the stand 1. Because the feet 17 are part of the sides 4 and 5 rather than the horizontal support 2, the feet 17 may be elevated relative to the bottom of the stand 1. This may make the stand 1 more stable on non-uniform surfaces, such as carpet. This may control the contact points of the stand 1, instead of having it floating on the carpet and causing a tendency to rock. The elevated feet 17 may be the contact point at the back of the stand 1, and may also result in the front edge of the stand 1 contacting the resting surface, servicing as a definite contact point for the front of the stand 1.

Optionally, the front face 3 may be a separate piece that is clipped or fastened into place. When it is clipped or fastened into place, the front face 3 may extend below the plane of the bottom of the stand 1, making the front face 3 also a foot for the front and adding greater stability on irregular surfaces. The front face 3 may be in continuous contact with the floor, or may be designed so that only the corners contact the ground.

The stand 1 may incorporate one or more bumps on the bottom of the stand 1, allowing the stand 1 to sit on the bumps on the surface upon which the stand 1 will be used. The bumps may be molded into the stand 1 or may be separate pieces added thereto.

In general, the sides 4 and 5 may support the weight of the board, and may compensate for any overturning applied moment from the board weight. The sides 4 and 5 may be sufficiently long to prevent the stand from tipping due to the overturning moment. The horizontal support 2 may connect the sides 4 and 5 and keep them in place, while the front 2 and mid support 6 may prevent rotation of the hinges when the stand 1 is in the assembled configuration, resulting in a rigid assembled product.

Figure 13:
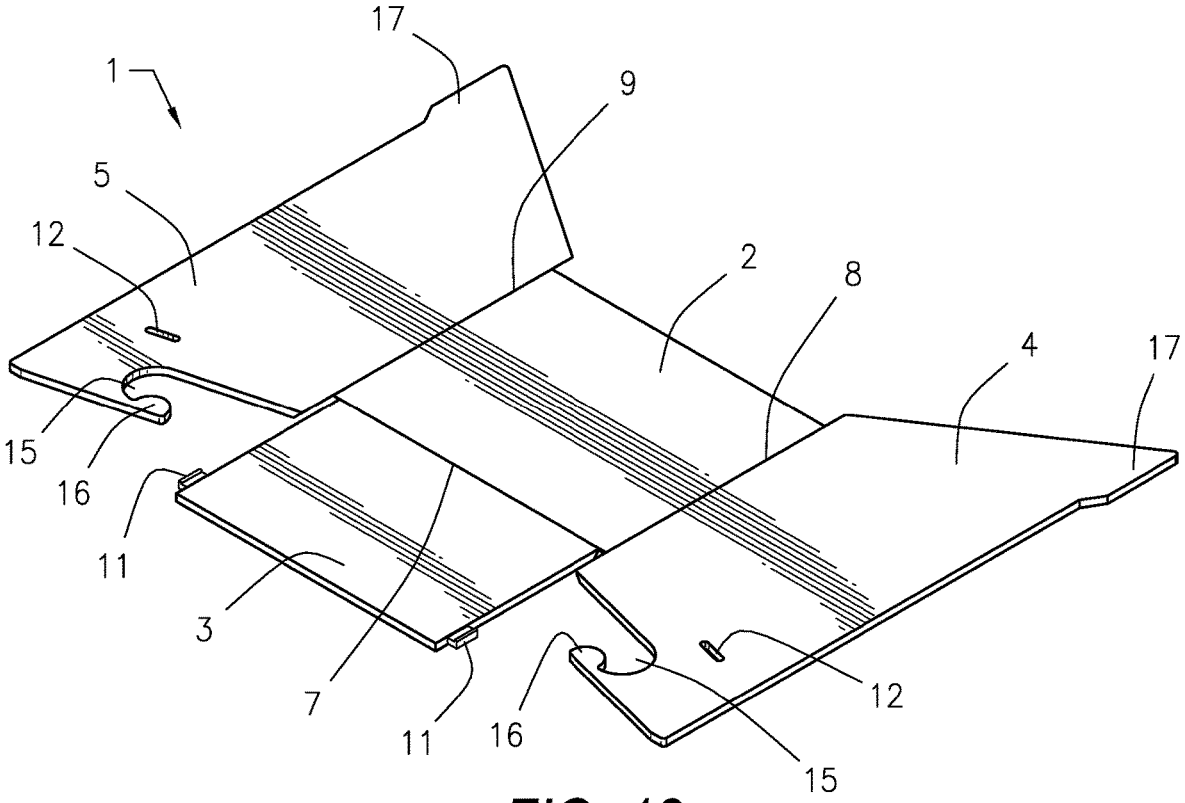
FIG. 13 is a perspective view of a top-fold version of the skateboard stand in a flat configuration.

When not in use as a stand, such as when newly made, during shipping, or when being stored, the stand 1 may lie flat, with the horizontal support 2, front face 3 and/or mid support 6, right side 4, and left side 5 all lying in the same plane, as shown in FIG. 1 and FIG. 13. To be more compact, one or more of the front face 3, right side 4, left side 5, and/or mid support 6 may be folded inward to lie in one or more planes parallel to the plane in which the horizontal support 2 lies, making a smaller footprint for storing or shipping the stand 1. In particular, if the hinges are living hinges as described above, the right side 4 and left side 5 may be folded backward to lie against the bottom of the horizontal support 2, with the front face 3 folded either backward to lie against the right side 4 and left side 5 or forward to lie against the top of the horizontal support 2.

The entire stand 1 may be molded, machined, or stamped from a single piece of material. This may make manufacture easy and inexpensive and may improve the user experience, as it may be easier to assembly without the confusion of multiple parts that may be difficult to assembly or may get lost. The stand 1 may include one or more cutouts 18, as shown. This may reduce the weight of the stand 1 and also help with aesthetics. Alternately, the stand 1 may feature all solid parts with no cutouts 18, if desired. The stand 1 may have the proportions shown or may be made taller or longer to increase stability.

Figure 14:
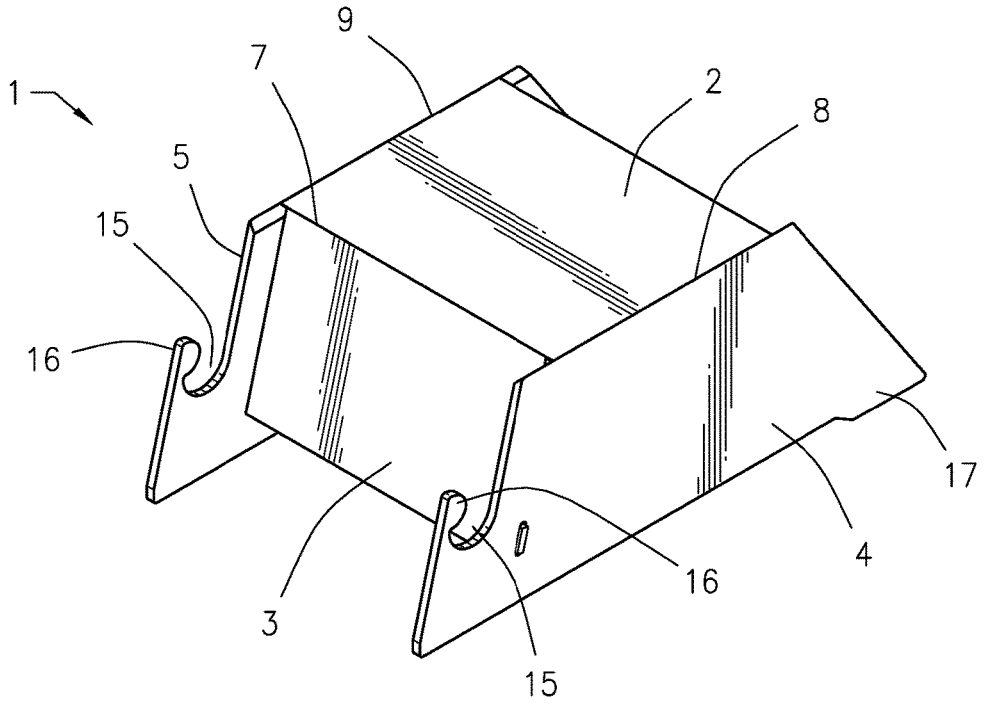
FIG. 14 is a perspective view of the top-fold version of the skateboard stand in an assembled configuration.

The horizontal support 2 may be the bottom of the stand 1, but this is not required, as its primary purpose may be to connect the two sides 4 and 5. As noted above, the horizontal support 2 may be the top of the stand. Alternately, the horizontal support 2 may be located anywhere between the bottom and top of the stand 1. While called horizontal, the horizontal support 2 may be actually horizontal during use, as shown in FIGS. 2 and 14, or may be at an angle relative to the surface upon which the stand 1 is used, as shown in FIG. 16.

Whereas, the devices and methods have been described in relation to the drawings and claims, it should be understood that other and further modifications, apart from those shown or suggested herein, may be made within the spirit and scope of this invention.

What is claimed is:

1. A stand capable of supporting a skateboard, where the stand is capable of being stored or shipped flat, the stand comprising:

a horizontal support;

a right side;

a left side; and a lateral support, where the horizontal support, the right side, the left side, and the lateral support are capable of lying in the same plane when the stand is not in use;

the stand further comprising a slot in the right side and a slot in the left side, each slot formed between a front edge and a back edge with a top opening, where the front edge is forward of the back edge and the back edge angles backward from bottom to top, where the slots are capable of receiving the skateboard such that an edge of the skateboard is located between the front edge and the back edge and the skateboard angles backward, resting on the back edge, a lip projecting into the slot between the front edge and the back edge;

where the right side and the left side are elongate such that each comprise a foot extending backward relative to the location of the slots and where each foot is of a length to counterbalance the skateboard when the skateboard is in place on the stand.

2. The stand of claim 1 where all parts of the stand are formed unitarily and are of a single, undivided piece of material.

3. The stand of claim 1 where the lateral support is a front face attached to the front edge of the horizontal support.

4. The stand of claim 1 where the lateral support is a mid support attached to the back edge of the horizontal support.

5. The stand of claim 1, where:

the right side is attached to a right edge of the horizontal support;

the left side is attached to a left edge of the horizontal support; and the lateral support is attached to a front edge or a back edge of the horizontal support.

6. The stand of claim 5 where:

the right side is capable of folding upright relative to the horizontal support;

the left side is capable of folding upright relative to the horizontal support; and the lateral support is capable of folding upright relative to the horizontal support and being removably attached to the right side and the left side.

7. The stand of claim 5 where:

the right side is capable of folding downward relative to the horizontal support;

the left side is capable of folding downward relative to the horizontal support; and the lateral support is capable of folding downward relative to the horizontal support and being removably attached to the right side and the left side.

8. The stand of claim 5 where:

the right side is attached to the right edge of the horizontal support via a hinge;

the left side is attached to the left edge of the horizontal support via a hinge; and the lateral support is attached to the front edge or the back edge of the horizontal support via a hinge.

9. The stand of claim 8 where the three hinges are living hinges.

10. The stand of claim 5 further comprising:

at least one tab projecting from a front or back edge of the right side;

at least one tab projecting from a front or back edge of the left side;

at least one slot in the lateral support corresponding to the tab projecting from the front or back edge of the right side; and at least one slot in the lateral support corresponding to the tab projecting from the front or back edge of the left side, where the slots are capable of receiving and removably retaining their corresponding tabs.

11. The stand of claim 1 where the right side is separate from the horizontal support and where the left side is separate from the horizontal support when the stand is disassembled.

* * * * *